US009692125B1

(12) United States Patent
Channabasappa et al.

(10) Patent No.: US 9,692,125 B1
(45) Date of Patent: Jun. 27, 2017

(54) HIGH GAIN ANTENNA STRUCTURE FOR BEAM SCANNING

(71) Applicant: Amazon Technologies, Inc., Reno, NV (US)

(72) Inventors: Eswarappa Channabasappa, Sunnyvale, CA (US); Adrian Napoles, Cupertino, CA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 14/853,465

(22) Filed: Sep. 14, 2015

(51) Int. Cl.

| | |
|---|---|
| ***H01Q 19/10*** | (2006.01) |
| ***H01Q 3/24*** | (2006.01) |
| ***H01Q 9/04*** | (2006.01) |
| ***H01Q 19/00*** | (2006.01) |

(52) U.S. Cl.
CPC ..... *H01Q 3/247* (2013.01); *H01Q 9/0407* (2013.01); *H01Q 9/0414* (2013.01); *H01Q 19/005* (2013.01)

(58) Field of Classification Search
CPC ..... H01Q 19/005; H01Q 19/10; H01Q 9/0407
See application file for complete search history.

(56) References Cited

U.S. PATENT DOCUMENTS

| | | | | |
|---|---|---|---|---|
| 6,501,427 | B1 * | 12/2002 | Lilly | H01Q 1/38 333/33 |
| 8,334,810 | B2 * | 12/2012 | Foo | H01Q 1/42 343/700 MS |
| 2013/0169503 | A1 * | 7/2013 | Fakharzadeh Jahromi | H01Q 1/243 343/833 |

* cited by examiner

*Primary Examiner* — Hoang Nguyen
(74) *Attorney, Agent, or Firm* — Lowenstein Sandler LLP

(57) ABSTRACT

Antenna structures and methods of operating the same are described. One antenna structure having a stacked patch antenna including a first patch structure disposed in a first plane and a second patch structure disposed in a second plane, a first parasitic patch antenna that is coplanar with the second patch structure, and a second parasitic patch antenna that is coplanar with the second patch structure. The first patch structure includes a first substrate with a ground plane and a first patch element. The second patch structure includes a second substrate with a second patch element. The first parasitic patch antenna is disposed adjacent a first side of the second patch structure in the second plane. The second parasitic patch antenna is disposed adjacent a second side of the second patch structure in the second plane.

20 Claims, 6 Drawing Sheets

HIGH GAIN ANTENNA STRUCTURE FOR BEAM SCANNING

BACKGROUND

A large and growing population of users is enjoying entertainment through the consumption of digital media items, such as music, movies, images, electronic books, and so on. The users employ various electronic devices to consume such media items. Among these electronic devices are electronic book readers, cellular telephones, personal digital assistants (PDAs), portable media players, tablet computers, netbooks, laptops and the like. These electronic devices wirelessly communicate with a communications infrastructure to enable the consumption of the digital media items. In order to wirelessly communicate with other devices, these electronic devices include one or more antennas.

BRIEF DESCRIPTION OF DRAWINGS

The present invention will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1A:
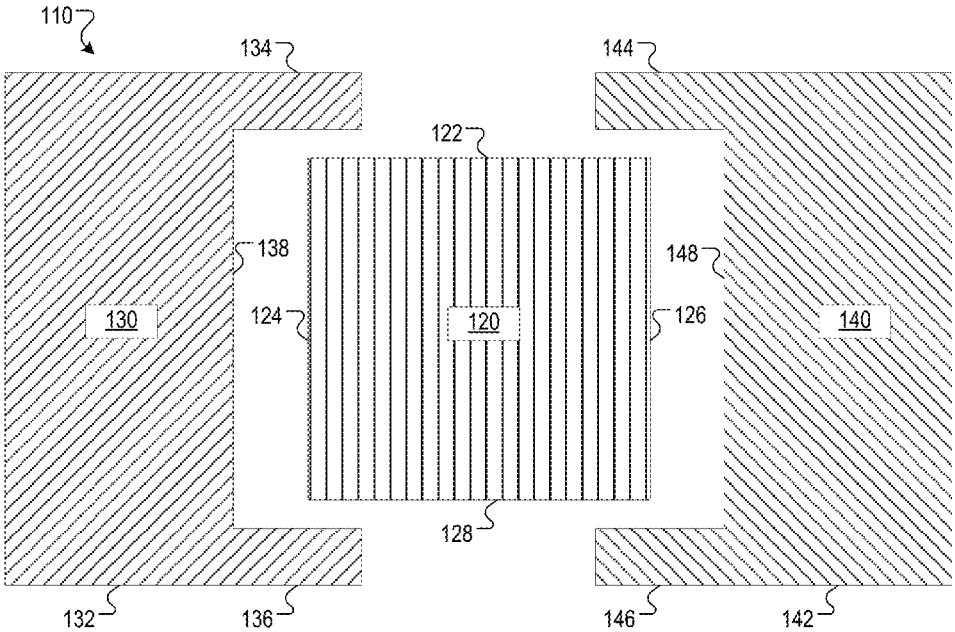
FIG. 1A is a top view of an antenna structure with a stacked patch antenna, a first parasitic patch antenna, and a second parasitic patch antenna according to one embodiment.

Antenna beamforming is a technology used to control the directionality of a transmission and reception of radio signals. Some conventional antenna systems direct a majority of signal energy transmitted in a chosen angular direction using an array of antennas. Additionally, some conventional antenna systems receive from a chosen angular direction by calibrating the array of antennas when receiving signals. The array of antennas can be directed or calibrated so that signals at particular angles experience constructive interference while others experience destructive interference to achieve spatial selectivity.

Antenna beamforming can improve connectivity of electronic devices by focusing energy in chosen directions to increase bandwidth of an antenna and improve link reliability by reducing interference. However, conventional phased array antennas are expensive and complex as the conventional phased array antennas use high insertion loss phase shifters. For example, a phase shifter can cost about $4 and incur an insertion loss about 4 dB. In this example, for a 4-element phased antenna array, the total cost could be approximately $20 without any significant enhancement in antenna gain as the array gain is nullified by an insertion loss of the phase shifters, power dividers, and power combiners. Alternatively, convention beamforming antenna systems can use a Butler matrix. For example, the outputs in an antenna system with a 4×4 Butler matrix are connected to 4 antenna elements. In this example, based on which of the four input ports of the Butler matrix receives a feed, beams of the 4 antenna elements of the antenna system with the 4×4 Butler matrix can be transmitted at four different angles. However, the antenna systems with Butler matrixes have considerable insertion loss. For example, the antenna system with the 4×4 Butler matrix can have four 3-dB couplers and two 45° delay lines that cause the insertion loss.

To achieve high data rates in a wireless local area network (WLAN) using antenna beamforming with high insertion loss, stronger receiving power (Rx) for a signal is needed. For example, to achieve a data rate of 400 megabits per second (Mbps) using an 80 megahertz (MHz) bandwidth, a received power level of the signal (referred to herein as signal strength) needs to be at the order of −60 decibel milliwatts (dBm). A required signal strength increases proportionately with a data throughput and a frequency bandwidth of an antenna system. For example, a bandwidth at 5 GHz gigahertz (GHz) with 160 MHz channels is relatively large compared to a bandwidth at 2.4 GHz with 20 MHz channels. However, path loss and attenuation is very high for the 5 GHz band. Signal attenuation through walls of a building is about 3 to 10 decibels (dB) higher at 5 GHz compared to 2.4 GHz.

The embodiments described herein may address the above noted deficiencies using an antenna structure with parasitic patch antennas coupled to a stacked patch antenna. The antenna structure employs reactive loading at radiating edges of the parasitic patch antennas using switches to adjust a beam direction of signals radiating from the antenna structure. Electronic devices can use one or more of the antenna structures to send and receive wireless communications or cellular communications. One advantage of the electronic devices using the beamforming antenna structure is to improve bandwidth utilization by increasing signal strength of a signal received or transmitted using the beamforming antenna structure by guiding a direction that a radio frequency (RF) wave is radiated. Another advantage of the electronic devices using the beamforming antenna structure is to increase a coverage range and decrease latency-sensitive transmissions of the antenna structure.

Examples of electronic devices include electronic book readers, portable digital assistants, mobile phones, laptop computers, portable media players, tablet computers, cameras, video cameras, netbooks, notebooks, desktop computers, gaming consoles, media streaming devices, set-top boxes (STBs), Blu-ray® or DVD players, media centers, drones, speech-based personal data assistants, and the like. The electronic device may connect to a network to obtain content from a server computing system (e.g., an item providing system) or to perform other activities. The electronic device may connect to one or more different types of cellular networks or wireless networks.

The antenna structure may have a unique structure, as described in more detail herein. A processing device of the electronic device can variably switch a coupling of the stacked patch antennas to parasitic patch antennas to change a phase of radiating edges of the antenna structure. Different phases of the radiating edges can adjust the beam angles of the antenna structure.

Several topologies of antenna structures are contemplated herein. The antenna structures described herein may be used for wireless area network (WAN) technologies, such as cellular technologies including Long Term Evolution (LTE) frequency bands, third generation (3G) frequency bands, Wi-Fi® and Bluetooth® frequency bands or other wireless local area network (WLAN) frequency bands, global navigation satellite system (GNSS) frequency bands (e.g., positioning system (GPS) frequency bands), and so forth.

FIG. 1A is a top view of an antenna structure 110 with a stacked patch antenna 120, a first parasitic patch antenna 130, and a second parasitic patch antenna 140 according to one embodiment. The stacked patch antenna 120 and the first and second parasitic patch antennas 130 and 140 are low profile antenna elements. In one embodiment, the stacked patch antenna 120 and the first and second parasitic patch antennas 130 and 140 are surface mounted onto a printed circuit board (PCB) or other components of an electronic device. In another embodiment, the stacked patch antenna 120 and the first and second parasitic patch antennas 130 and 140 are printed directly onto the PCB. For example, the stacked patch antenna 120 and the first and second parasitic patch antennas 130 and 140 can be formed on a dielectric substrate using similar materials and lithography processes as used to make PCBs.

In one example, the stacked patch antenna 120 includes a flat rectangular sheet or patch of metal mounted over a larger sheet of metal that is a ground plane. The stacked patch antenna 120 has a top edge 122, a first side edge 124, a second side edge 126, and a bottom edge 128. In one embodiment, the first parasitic patch antenna 130 and the second parasitic patch antenna 140 are adjacent to the stacked patch antenna 120. In another embodiment, the first parasitic patch antenna 130 and the second parasitic patch antenna 140 are located on different planes that are parallel to a plane of the stacked patch antenna 120. In another embodiment, the first parasitic patch antenna 130 partially surrounds the first side of the stacked patch antenna 120 and the second parasitic patch antenna 140 partially surrounds the second side of the stacked patch antenna 120.

In one embodiment, the antenna structure 110 is located on top of a substrate with a height or thickness of a dielectric constant. In one example, the height h may be much smaller than a wavelength (λ) of operation for the antenna structure. In another example, the height of the antenna structure is approximately 0.05λ-0.1λ. The length, width, or height of the antenna structure 110 is not intended to be limiting and can vary as topologies of the antenna structure 110 change.

The first parasitic patch antenna 130 can be parasitically coupled to the stacked patch antenna 120. For example, the first parasitic patch antenna 130 has a body 132 that is parasitically coupled to the stacked patch antenna 120. In one example, the body 132 is located parallel and adjacent to a top edge 122, a first side edge 124, a second side edge 126, or a bottom edge 128. In another example, the body 132 is coplanar to the stacked patch antenna 120.

In one embodiment, the first parasitic patch antenna 130 includes the body 132 with a first arm 134 and a second arm 136. The body 132, the first arm 134, and the second arm 136 can be parasitically coupled to the stacked patch antenna 120. In one embodiment, the first arm 134 and the second arm 136 extend from different sides of the body 132 to form and S-shaped parasitic patch antenna. In one embodiment, the first arm 134 and the second arm 136 are extend from to a same side of the body 132 to form a U-shaped parasitic patch antenna. In one example, the first arm 134 extends out from a side 138 of the body 132 past the first side edge 124 of the stacked patch antenna 120 and adjacent to the top edge 122 of the stacked patch antenna 120. In one example, the first arm 134 is coplanar to the upper patch structure of the stacked patch antenna 120 (illustrated in FIG. 1B). In another example, the second arm 136 extends out from the side 138 of the body 132 past the first side edge 124 of the stacked patch antenna 120 and adjacent to the bottom edge 128 of the upper patch structure. In one embodiment, the first arm 134 and the second arm 136 are coplanar to the upper patch structure 160 (illustrated in FIG. 1B) of the stacked patch antenna 120. In one embodiment, the first arm 134 and the second arm 136 are coplanar to the lower patch structure 159 (illustrated in FIG. 1B) of the stacked patch antenna 120.

An advantage of the U-shaped parasitic patch antenna is to provide the first parasitic patch antenna 130 that is closely spaced to the stacked patch antenna 120. The close spacing of the first parasitic patch antenna 130 and the stacked patch antenna 120 creates a stronger coupling effect between the first parasitic patch antenna 130 and the stacked patch antenna 120.

In one example, the first parasitic patch antenna 130 is located parallel to the first side edge 124. In this example, the body 132 is located parallel to the first side edge 124. Additionally, the first arm 134 is located parallel to a portion of the bottom edge 128 and the second arm 136 is located parallel to a portion of the top edge 122. The orientation and location of the body 132, the first arm 134, and the second arm 136 are not intended to be limiting and can vary. For example, the body 132 can be located parallel to the top edge 122, the first arm 134 can be located parallel to the first side edge 124, and the second arm 136 can be located parallel to the second side edge 126.

The second parasitic patch antenna 140 can be similar to the first parasitic patch 130 in structure and orientation. For example, the second parasitic patch antenna 140 has a body 142 that is parasitically coupled to the stacked patch antenna 120. In one example, the body 142 is located parallel and adjacent to the top edge 122, the first side edge 124, the second side edge 126, or the bottom edge 128. In another example, the body 132 is coplanar to the stacked patch antenna 120. The body 142 can be located on a different side of the stacked patch antenna 120 than the location of the body 132 of the first parasitic patch antenna 130.

In one embodiment, the second parasitic patch antenna 140 includes the body 142 with a first arm 144 and a second arm 146. In one example, the first arm 144 and the second arm 146 extend from a same side of the body 142. In another example, the first arm 144 and the second arm 146 extend from different sides of the body 142. In one example, the first arm 144 extends out from a side 148 of the body 142 past the second side edge 126 of the stacked patch antenna 120 and adjacent to the top edge 122 of the stacked patch antenna 120. In one example, the first arm 144 is coplanar to the upper patch structure of the stacked patch antenna 120 (illustrated in FIG. 1B). In another example, the second arm 146 extends out from the side 148 of the body 142 past the second side edge 126 of the stacked patch antenna 120 and adjacent to the bottom edge 128 of the upper patch structure. In one embodiment, the first arm 144 and the second arm 146 are coplanar to the upper patch structure 160 (illustrated in FIG. 1B) of the stacked patch antenna 120. In one embodiment, the first arm 144 and the second arm 146 are coplanar to the lower patch structure 159 (illustrated in FIG. 1B) of the stacked patch antenna 120. In another example, the body 142, the first arm 144, and the second arm 146 are parasitically coupled to the stacked patch antenna 120.

In one example, the second parasitic patch antenna 140 is located parallel to the second side edge 126. In this example, the body 142 is located parallel to the second side edge 126. Additionally, the first arm 144 is located parallel to a portion of the bottom edge 128 and the second arm 146 is located parallel to a portion of the top edge 122. The orientation and location of the body 142, the first arm 144, and the second arm 146 are not intended to be limiting and can vary. For example, the body 142 can be located parallel to the top edge 122, the first arm 144 can be located parallel to the first side edge 124, and the second arm 146 can be located parallel to the second side edge 126.

In one embodiment, the second parasitic patch antenna 140 can mirror the first parasitic patch antenna 130. For example, the body 132 of the first parasitic patch antenna 130 can be located coplanar and parallel to the first side edge 124 of the stacked patch antenna 120 and the body 142 of the second parasitic patch antenna 140 can be located coplanar and parallel to the second side 126 of the stacked patch antenna 120. One advantage of the stacked patch antenna 120 with the first and second parasitic patch antennas 130 and 140 is that the antenna structure 110 has a relatively high gain with a compact form. For example, the antenna structure 110 has a gain of 9 decibels relative to an isotropic antenna (dBi). In another example, the antenna structure 110 is approximately 27 millimeters (mm) in length and approximately 42 mm in width. In another example, the microstrip patch antennas 130 and 140 are each be approximately 14 mm in width by 25 mm in length. In another example, the stacked patch antenna 120 is approximately 15 mm by 15 mm. In another example, the lower patch structure 155 and the upper patch structure 157 are the same size. In another example, the lower patch structure 155 and the upper patch structure 157 are different sizes. Another advantage of the stacked patch antenna 120 with the parasitically coupled parasitic patch antennas 130 and 140 is minimizing or eliminating feed line intersections. For example, a conventional antenna array configured for beamforming includes multiple feed lines running to different antennas, where the multiple feed lines may intersect and cause interference to a signal. In this example, the stacked patch antenna 120 with the parasitic patch antennas 130 and 140 can avoid feed line intersection where the stacked patch antenna 120 can be driven by a radio frequency (RF) feed, as discussed in further detail in the proceeding paragraphs.

Figure 1B:
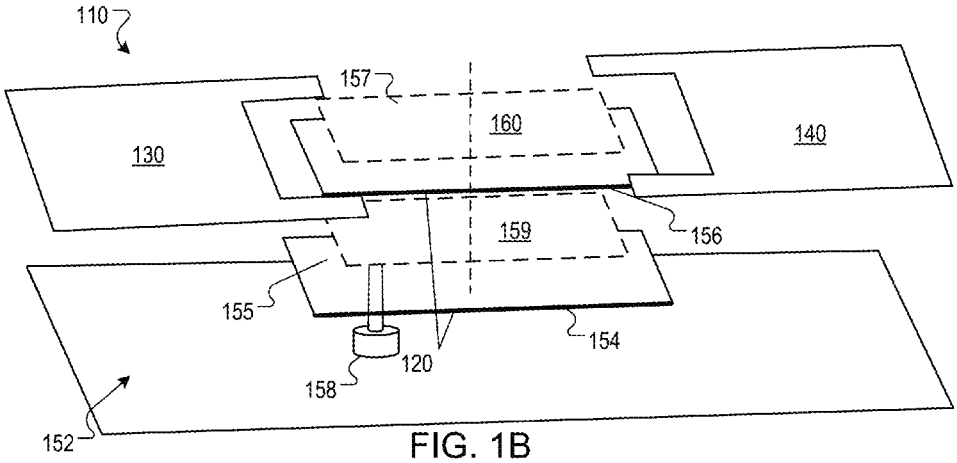
FIG. 1B is a perspective view of the antenna structure with the stacked patch antenna, the first parasitic patch antenna, the second parasitic patch antenna, and an RF feed according to one embodiment

FIG. 1B is a perspective view of the antenna structure 110 with the stacked patch antenna 120, the first parasitic patch antenna 130, the second parasitic patch antenna 140, a ground plane 152, and an RF feed 158 according to one embodiment. The stacked patch antenna 120 can include: a lower patch structure 155 and an upper patch structure 157. The lower patch structure 155 is layered below the upper patch structure 157 along a vertical axis. For example, the lower patch structure 155 is on a first plane and the upper patch structure 157 is on a second plane. The first plane and the second plane can be layered in parallel of each other. In one embodiment, the lower patch structure 155 and the upper patch structure 157 are separated by a dielectric layer between the lower patch structure 155 and the upper patch structure 157. In another embodiment, the lower patch structure 155 is directly connected to the upper patch 157. In another embodiment, the upper patch structure 157 is electromagnetically coupled to the lower patch structure 155 and separated by the substrate 156.

In one embodiment, the upper patch structure 157 includes a substrate 156. In one example, a patch element 160 is mounted on a top side of the substrate 156. In another example, the patch element 160 is integrated into the substrate 156. In another embodiment, the lower patch structure 155 includes a substrate 154. In one example, a patch structure 159 is mounted on a top side of the substrate 154. In another example, the patch structure 159 is integrated into the substrate 154. In one example, the ground plane 152 integrated on a bottom side of the substrate 154. In another example, the ground plane 152 can be a separate layer located along a same vertical axis as the lower patch structure 155 and the upper patch 157. In another example, the substrates 154 and 156 are dielectric substrates. The dielectric constants (∈') of the substrates 154 and 156 range from 2-9∈', The lower patch structure 155 can be connected to the RF feed 158 that drives the lower patch structure 155 with a signal from a radio frequency (RF) circuit of an electronic device. For example, the RF feed 158 is connected to the RF circuit that generates signals to drive the lower patch structure 155. In this example, the antenna structure 110 receives the signal via the RF feed 158 and resonates at a frequency based on the received signal. In one embodiment, the RF feed 158 is connected to the bottom side of the substrate 154. In another embodiment, the RF feed 158 is a coaxial pin. In another embodiment, the RF feed 158 is a feed line connected to the antenna structure 110 with a connector. The RF feed 158 can be connected to the lower patch structure 155 through a hole in the ground plane 152 for the coaxial central pin.

In one embodiment, the electronic device uses a single antenna structure 110 to direct an RF wave in a selected direction. In another embodiment, the electronic device uses an array or string of antenna structures 110 to direct multiple RF waves in different directions. One advantage of the electronic device using the array of antenna structures 110 is to direct multiple waves in different directions and increase an overall signal gain of the electronic device.

Figure 2:
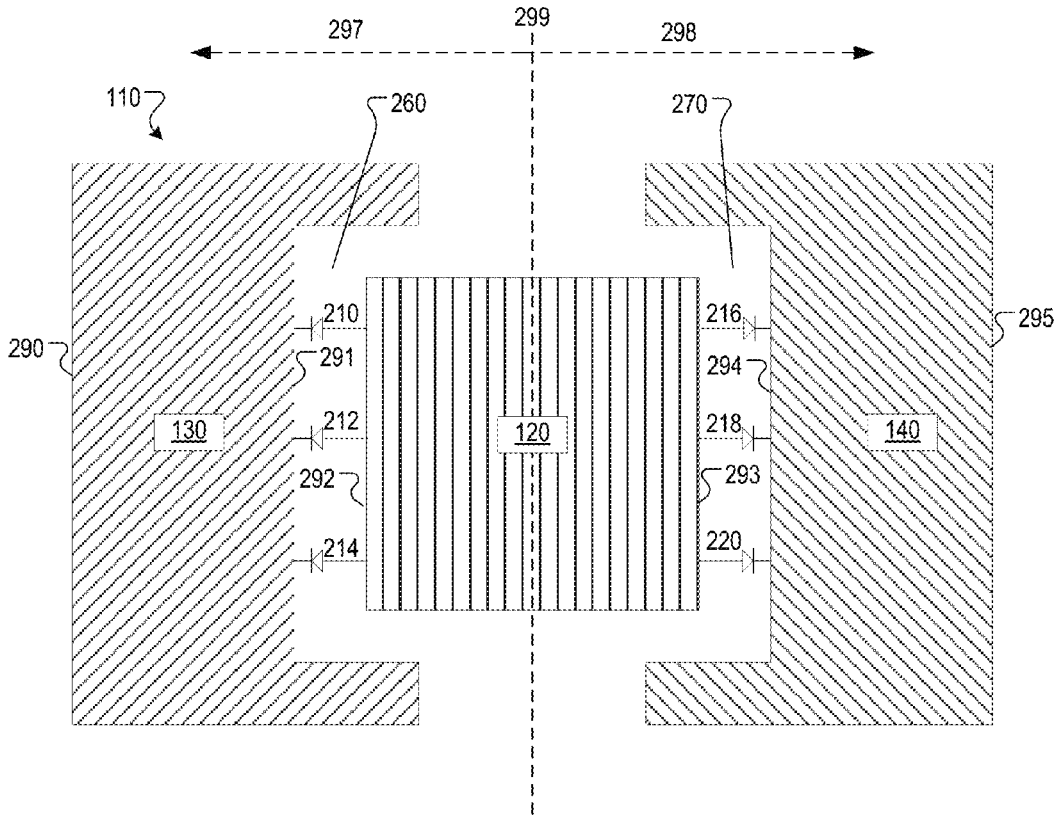
FIG. 2 illustrates the antenna structure with switches between the stacked patch antenna, the first parasitic patch antenna, and the second parasitic patch antenna according to one embodiment

FIG. 2 illustrates the antenna structure 110 with switches between the stacked patch antenna 120, the first parasitic patch antenna 130, and the second parasitic patch antenna 140 according to one embodiment. In one embodiment, the antenna structure 110 has a gap 260 between the stacked patch antenna 120 and the first parasitic patch antenna 130. Switches 210, 212, and 214 can be placed across the gap 260 to couple the stacked patch antenna 120 to the first parasitic patch antenna 130. In one example, the switches 210, 212, and 214 can couple the upper patch structure 157 (illustrated in FIG. 1B) of the stacked patch antenna 120 to the first parasitic patch antenna 130.

In another embodiment, the antenna structure 110 has a gap 270 between the stacked patch antenna 120 and the second parasitic patch antenna 140. Switches 216, 218, and 220 can be placed across the gap 270 to couple the stacked patch antenna 120 to the second parasitic patch antenna 140. In one example, the switches 216, 218, and 220 can couple the upper patch structure 157 of the stacked patch antenna 120 to the second parasitic patch antenna 140. In another example, the switches 216, 218, and 220 can couple the lower patch structure 155 of the stacked patch antenna 120 to the second parasitic patch antenna 140. In one embodiment, the space of the gap 260 between the he stacked patch antenna 120 to the first parasitic patch antenna 130 is the same as the space of the gap 270 between the stacked patch antenna 120 and the second parasitic patch antenna 140. In another embodiment, the gaps 260 and 270 are each approximately 1 mm.

The antenna structure 110 can include edges 290, 291, 292, 293, 294, and 295. In one embodiment, the edges 290, 291, 292, 293, 294, and 295 are radiating edges of the stacked patch antenna 120, the first parasitic patch antenna 130, or the second parasitic patch antenna 140. Radiating edges are edges of the stacked patch antenna 120, the first parasitic patch antenna 130, or the second parasitic patch antenna 140 where a fringing of an electromagnetic fields occur. The fringing of the electromagnetic fields cause a radiation of the electromagnetic fields because the fringing electromagnetic fields on the edge of the stacked patch antenna 120, the first parasitic patch antenna 130, or the second parasitic patch antenna 140 add up in phase and produce a radiation of the electromagnetic fields. In one embodiment, the first parasitic patch antenna 130 includes radiating edges 290 and 291. In another embodiment, the stacked patch antenna 120 includes radiating edges 292 and 293. In another embodiment, the second parasitic patch antenna 140 has radiating edges 294 and 295.

Reactive loading can be employed at the edges 290, 291, 292, 293, 294, and 295 of the antenna structure 110 using switches 210, 212, 214, 216, 218, and 220. The switches 210, 212, 214, 216, 218, and 220 can provide a path for a current generated by the signal from the RF circuit. In one embodiment, the switches 210, 212, and 214 are mounted across the gap 260 to couple the stacked patch antenna 120 and the first parasitic patch antenna 130. In another embodiment, the switches 216, 218, and 220 are mounted across the gap 270 to couple the stacked patch antenna 120 and the first parasitic patch antenna 130. The switches 210, 212, 214, 216, 218, and 220 may be switched on or off to adjust a beam of the antenna structure 110, as further discussed in the proceeding paragraphs. The antenna structure 110 is modified using switches to obtain a phase difference between the radiating edges. The phase difference the antenna structure 110 can adjust the antenna beam to beam scan in different directions.

In one example, the RF circuit of the electronic device can turn one or a combination of the switches 210, 212, 214, 216, 218, and 220 on or off to adjust a current flow of the antenna structure 110. In another example, an application processor, coupled to the RF circuit, can control an on and off position of switches 210, 212, 214, 216, 218, and 220. As the current flow of the antenna structure 110 is adjusted, a scanning of the beam can be moved around a center axis 299 between a first side 297 of the antenna structure 110 and a second side 298 of the antenna structure 110. In another example, the application processor can switch the antenna structure 110 between different radiation modes using one or combination of the switches 210, 212, 214, 216, 218, and 220. For example, the application processor can switch the switches 210, 212, 214, 216, 218, and 220 to a first mode where the antenna structure 110 radiates electromagnetic energy away from a first side of the antenna structure 110 towards a second side of the antenna structure 110 in the first radiation mode. In another example, the application processor can switch the switches 210, 212, 214, 216, 218, and 220 to a second mode where the antenna structure 110 radiates the electromagnetic energy away from the second side of the antenna structure 110 towards the second side of the antenna structure in the second radiation mode. In another example, the application processor can switch the switches 210, 212, 214, 216, 218, and 220 to a third mode where the antenna structure 110 radiates the electromagnetic energy along a center axis of the antenna structure 110, as discussed herein.

In one embodiment, a processing device of the electronic device using the antenna structure 110 can determine which of the switches 210, 212, 214, 216, 218, and 220 to turn on and off to steer a majority of a beam or RF wave of the antenna structure 110 to a desired pitch or angle. In one example the processing device is the RF circuit. In another example, the processing device is processing logic that may include hardware (e.g., circuitry, dedicated logic, programmable logic, microcode, etc.), software (e.g., instructions executed by a processing device), firmware, or a combination thereof.

In one embodiment, the processing device turns the switches 210, 212, 214, 216, 218, and 220 on and off using a predetermined configuration. For example, the processing device can determine a location of the electronic device and turn the switches 210, 212, 214, 216, 218, and 220 on and off using a predetermined configuration for that location. In another embodiment, the processing device uses a predetermined pattern or random pattern of turning different combinations of switches 210, 212, 214, 216, 218, and 220 on and off and measure a signal strength for the different combinations. For example, the processing device turns on switch 210 for a first switch combination and measure a first signal strength, turns on switches 218 and 220 for a second switch combination and measure a second signal strength, and turns on switches 212, 214, and 216 for a third switch combination and measure a third signal strength. In this example, the processing device compares the first, second, and third signal strengths to determine a highest signal strength for the first, second, and third switch combinations. The processing device can then set the switches to the switch combination with the highest signal strength.

Figure 3A:
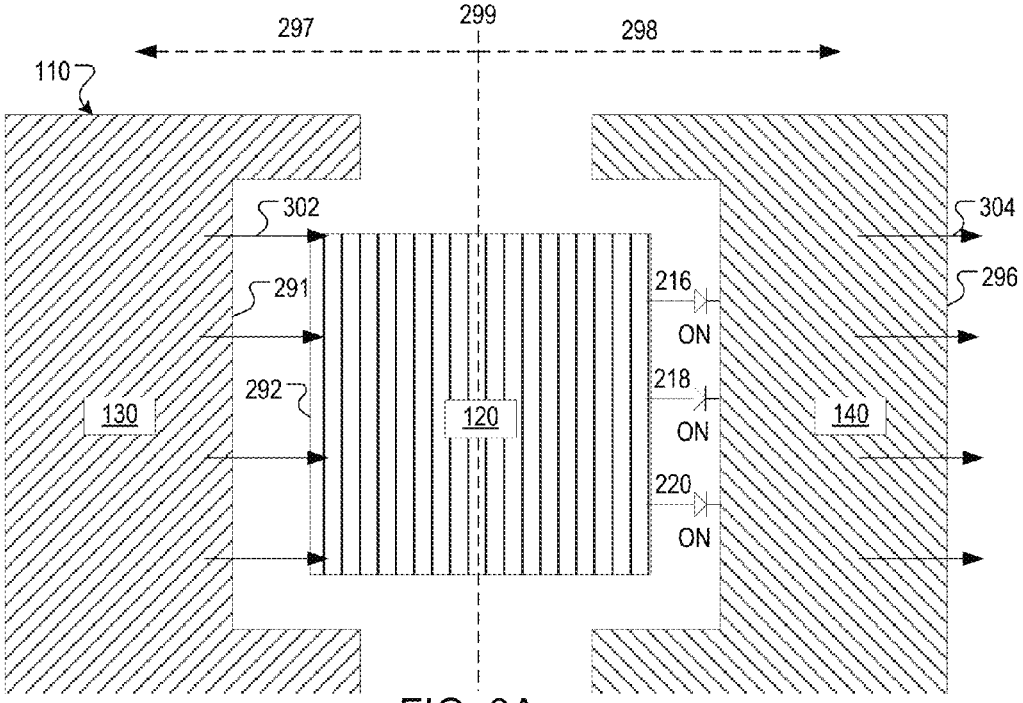
FIG. 3A illustrates the antenna structure configured to steer a signal toward the first side from the center axis according to one embodiment.

FIG. 3A illustrates the antenna structure 110 configured to steer a majority of a RF wave toward the first side 297 from the center axis 299 according to one embodiment. In one embodiment, when the antenna structure 110 is configured to steer the majority of the RF wave to the first side 297, the switches 216, 218, and 220 are turned on. For example, when the switches 216, 218, and 220 are turned on, the radiating edges of the antenna structure 110 are edges 291, 292, and 296. In this example, when the majority of RF wave is steered to the first side 297, the current 302 flows from the first parasitic patch antenna 130 to the stacked patch antenna 120 and the current 304 flows from a center of the second parasitic patch antenna 140 to the edge 296.

Figure 3B:
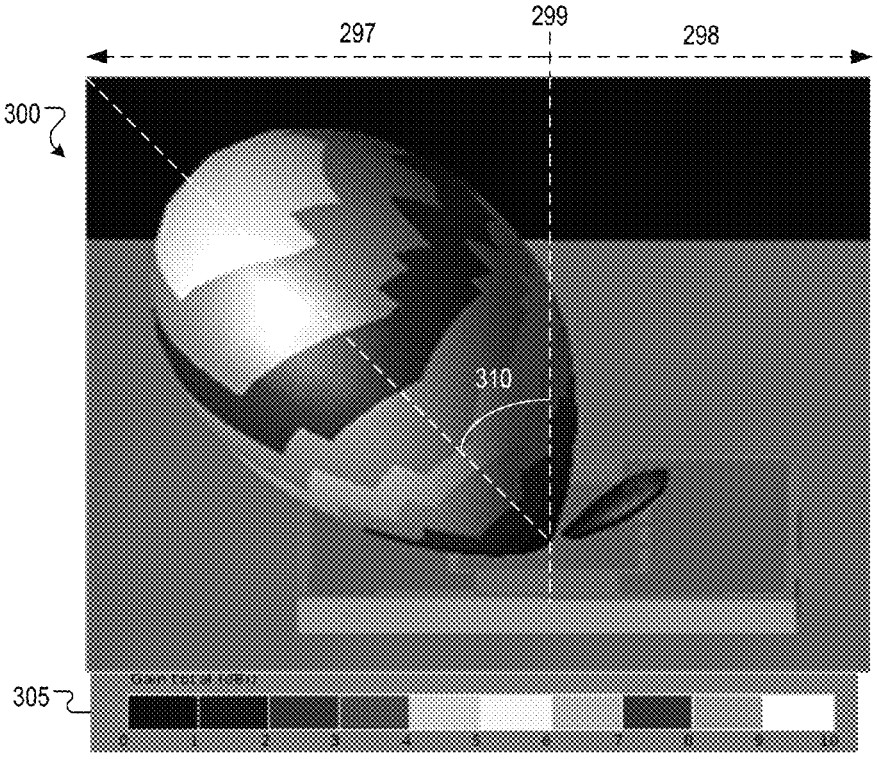
FIG. 3B illustrates a radiation pattern of the antenna structure when the antenna structure is configured to steer the signal toward the first side according to one embodiment.

FIG. 3B illustrates a RF wave 300 of the antenna structure 110 when the antenna structure 110 is configured to steer a majority of the RF wave toward the first side 297 according to one embodiment. The spectrum chart 305 indicates a total gain from 0 to 10 dBi of the signal for the RF wave 300. The RF wave 300 can have a peak gain of approximately 10 dBi. The angle or pitch 310 of the RF wave 300 from the center axis 299 toward the first side 297 can be adjusted based on which of the switches 216, 218, and 220 are turned on. For example, when the switches 216 and 218 are turned on, the angle 310 of the RF wave 300 is increased to be closer to the center axis 299 as compared to when the switches 216, 218, and 220 are turned on. In another example, the RF wave 300 is directed to a side of the antenna structure 110 that is opposite the switches 216, 218, and 220. In another example, when the switch 218 is turned on, the angle 310 of the RF wave 300 can further be increased to be closer to the center axis 299 compared to when the switches 216, 218, and 220 or the switches 216 and 218 are turned on.

Figure 4A:
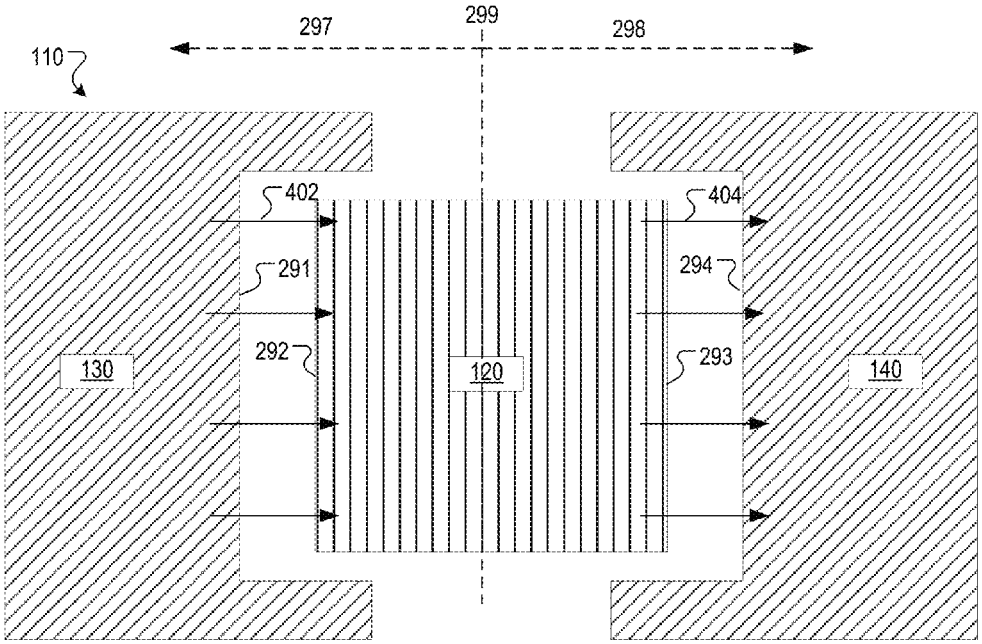
FIG. 4A illustrates the antenna structure configured to steer a signal along the center axis according to one embodiment.

FIG. 4A illustrates the antenna structure 110 configured to steer a majority of a RF wave along the center axis 299 according to one embodiment. In one embodiment, when the antenna structure 110 is configured to steer the majority of the RF wave along the center axis 299, the switches 210, 212, 214, 216, 218, and 220 are turned off. For example, when the switches 210, 212, 214, 216, 218, and 220 are turned off, the radiating edges of the antenna structure 110 are edges 291, 292, 293, and 294. In this example, when the antenna structure 110 steers the majority of the RF wave along the center axis 299, the current 402 flows from edge 291 to edge 292 and the current 404 flows from edge 293 to edge 294.

Figure 4B:
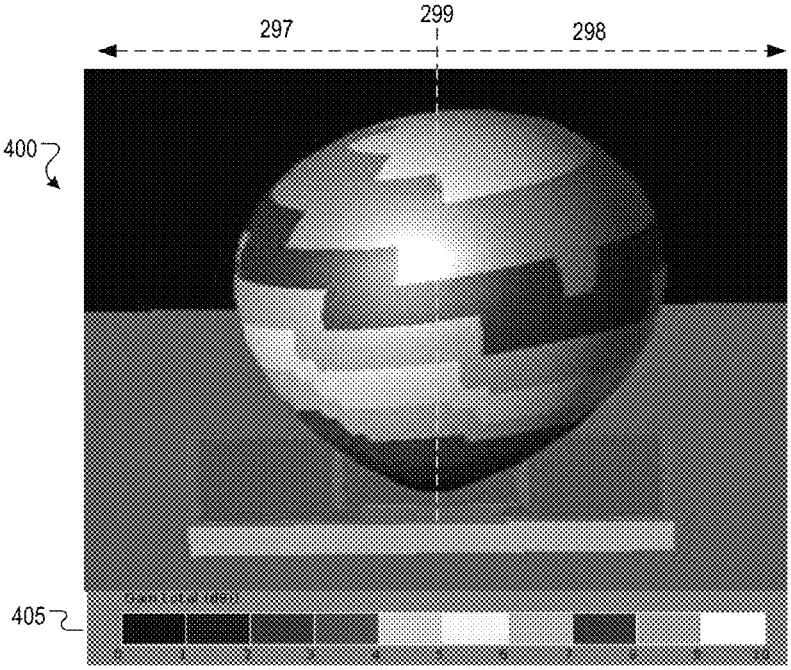
FIG. 4B illustrates a radiation pattern of the antenna structure when the antenna structure is configured to steer the signal along the center axis according to one embodiment.

FIG. 4B illustrates a RF wave 400 of the antenna structure 110 when the antenna structure 110 is configured to steer the majority of the RF wave along the center axis 299 according to one embodiment. The spectrum chart 405 indicates a total gain from 0 to 10 dBi of the signal for the RF wave 400. The RF wave 400 can have a peak gain of approximately 10 dBi.

Figure 5A:
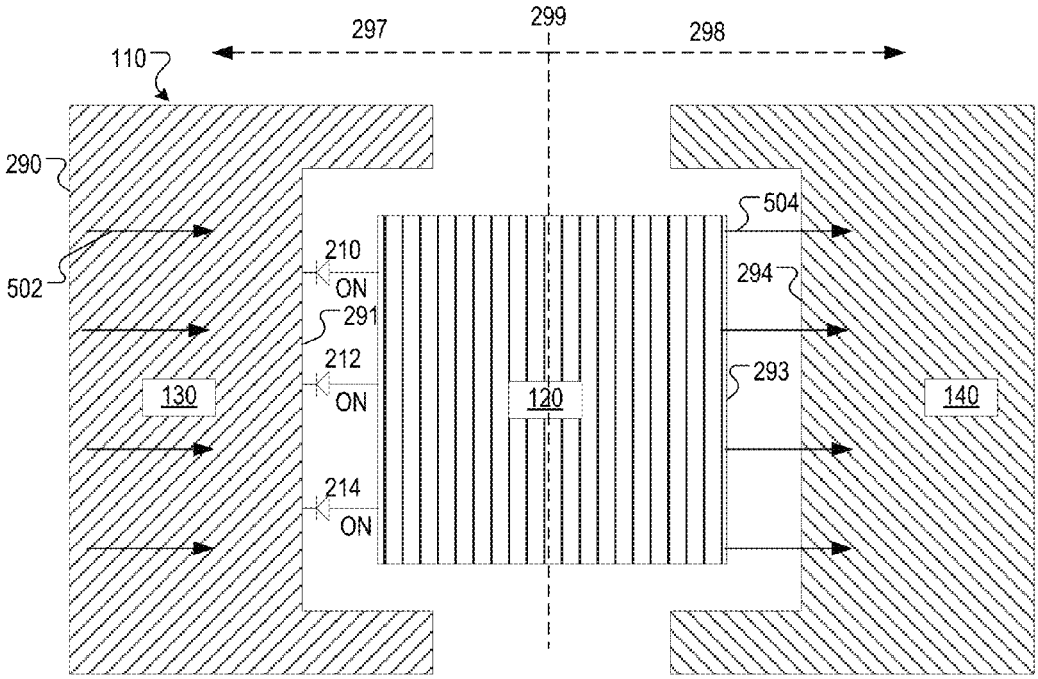
FIG. 5A illustrates the antenna structure configured to steer the signal toward the second side according to one embodiment.

FIG. 5A illustrates the antenna structure 110 configured to steer a majority of the RF wave toward the second side 298 according to one embodiment. In one embodiment, when the antenna structure 110 is configured steer the majority of the RF wave toward the second side 298, the switches 210, 212, and 214 are turned on. For example, when the switches 210, 212, and 214 are turned on, the radiating edges of the antenna structure 110 are edges 290, 293, and 294. In this example, when the antenna structure 110 is steering the majority of the RF wave toward the second side 298, the current 502 flows from the edge 290 towards the edge 291 and the current 504 flows from the edge 293 to edge 294.

Figure 5B:
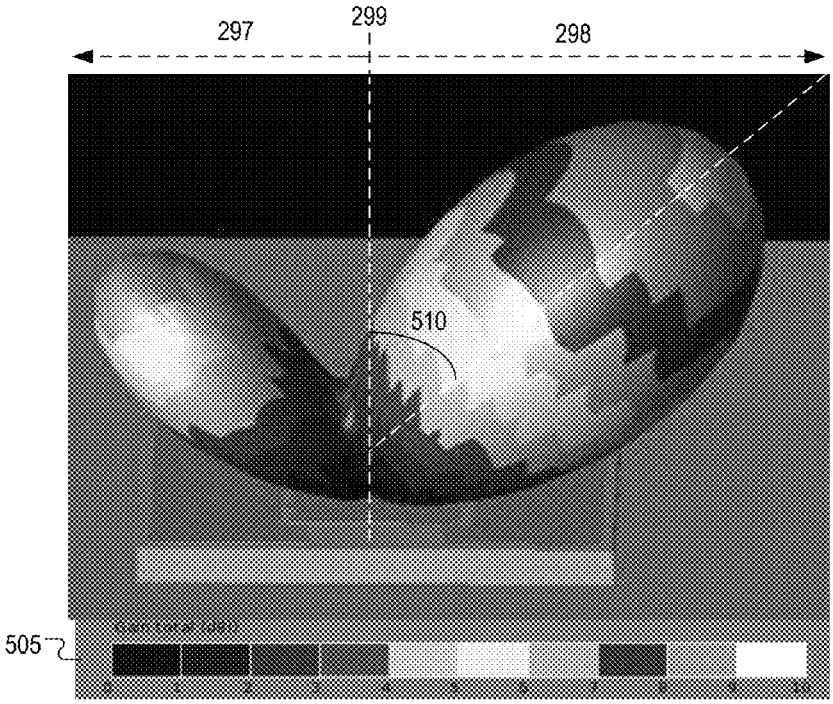
FIG. 5B illustrates a radiation pattern of the antenna structure when the antenna structure is configured to steer the signal toward the second side according to one embodiment.

FIG. 5B illustrates a RF wave 500 of the antenna structure 110 when the antenna structure 110 is configured to steer the majority of the RF wave toward the second side 298 according to one embodiment. The spectrum chart 505 indicates a total gain from 0 to 10 dBi of the signal for the RF wave 500. The RF wave 500 can have a peak gain of approximately 10 dBi. The angle or pitch 510 of the RF wave 500 toward the second side 298 can be adjusted based on which of the switches 210, 212, and 214 are turned on. For example, when the switches 210 and 212 are turned on, the angle 510 of the RF wave 500 is increased to be closer to the center axis 299 compared to when the switches 210, 212, and 214 are turned on are turned on. In another example, when the switch 212 is turned on, the angle 510 of the RF wave 500 is further increased to be closer to the center axis 299 compared to when the switches 210, 212, and 214 or the switches 210 and 212 are turned on are turned on. In another example, the RF wave 500 is directed to a side of the antenna structure 110 that is opposite the switches 210, 212, and 214.

The number of switches in FIGS. 2, 3A, 4A, and 5A can vary and is not intended to be limiting. In one example, a granularity of the angle or pitch of the beam or RF wave of the antenna structure 110 away from the center axis 299 can be increased as the number of switches is increased. In another example, the granularity of the angle or pitch of the beam of the antenna structure 110 away from the center axis 299 can be decrease as the number of switches is decreased.

Figure 6:
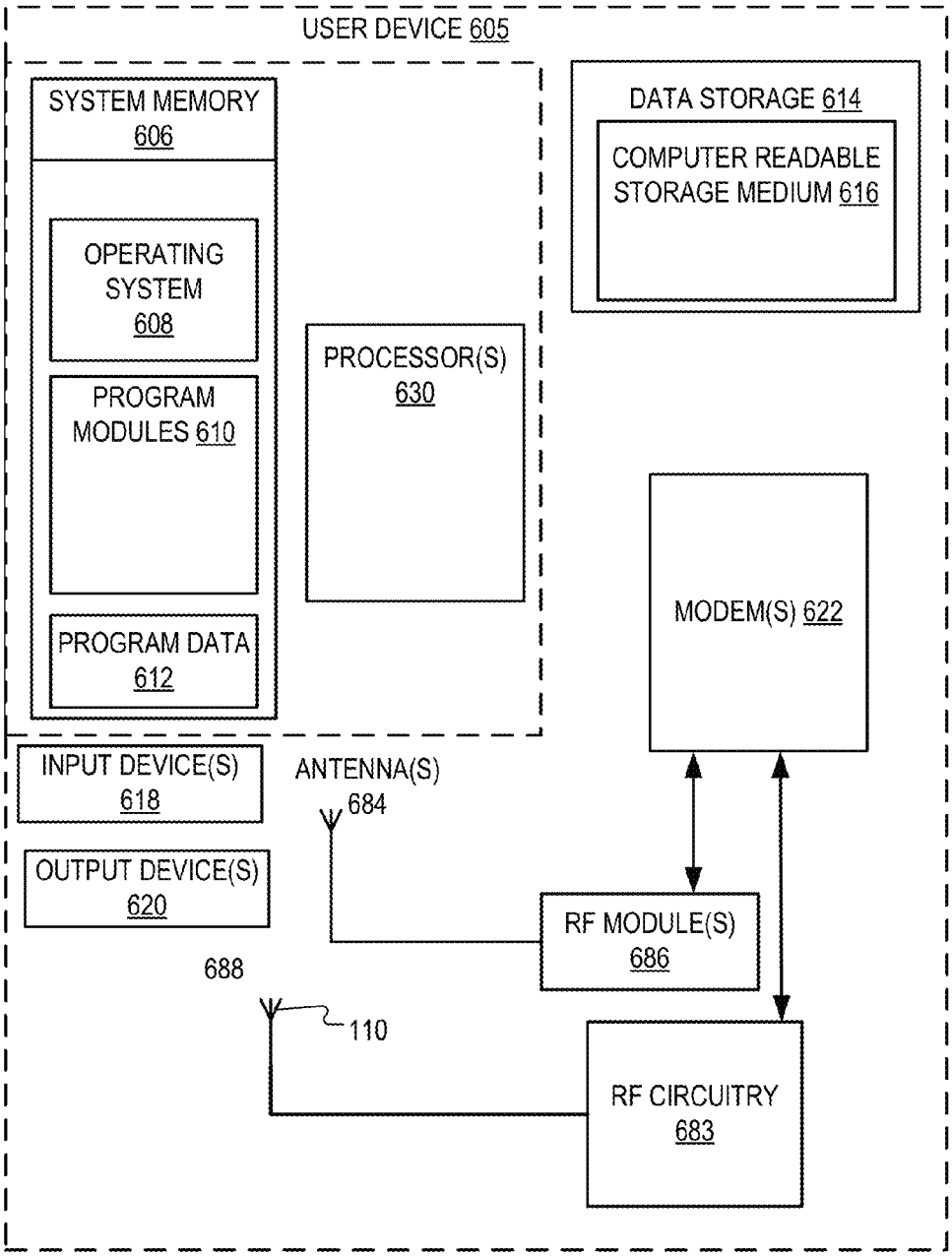
FIG. 6 is a block diagram of an electronic device in which embodiments of a radio device with an antenna structure may be implemented.

FIG. 6 is a block diagram of an electronic device or user device 605 in which embodiments of an antenna structure 688 with a stacked patch antenna, a first parasitic patch antenna, and a second parasitic patch antenna may be implemented. The antenna structure 688 may correspond to the antenna structure 110 of FIG. 1. The user device 605 may be any type of computing device such as an electronic book reader, a PDA, a mobile phone, a laptop computer, a portable media player, a tablet computer, a camera, a video camera, a netbook, a desktop computer, a gaming console, a DVD player, a Blu-ray®, a computing pad, a media center, a voice-based personal data assistant, and the like. The user device 605 may be any portable or stationary electronic device. For example, the user device 605 may be an intelligent voice control and speaker system. Alternatively, the user device 605 may be any other device used in a WLAN network (e.g., Wi-Fi® network), a WAN network, or the like.

The user device 605 includes one or more processor(s) 630, such as one or more CPUs, microcontrollers, field programmable gate arrays, or other types of processors. The user device 605 also includes system memory 606, which may correspond to any combination of volatile and/or non-volatile storage mechanisms. The system memory 606 stores information that provides operating system component 608, various program modules 610, program data 612, and/or other components. In one embodiment, the system memory 606 stores instructions of the methods as described herein. The user device 605 performs functions by using the processor(s) 630 to execute instructions provided by the system memory 606.

The user device 605 also includes a data storage device 614 that may be composed of one or more types of removable storage and/or one or more types of non-removable storage. The data storage device 614 includes a computer-readable storage medium 616 on which is stored one or more sets of instructions embodying any of the methodologies or functions described herein. Instructions for the program modules 610 may reside, completely or at least partially, within the computer-readable storage medium 616, system memory 606 and/or within the processor(s) 630 during execution thereof by the user device 605, the system memory 606 and the processor(s) 630 also constituting computer-readable media. The user device 605 may also include one or more input devices 618 (keyboard, mouse device, specialized selection keys, etc.) and one or more output devices 620 (displays, printers, audio output mechanisms, etc.).

The user device 605 further includes a modem 622 to allow the user device 605 to communicate via a wireless network (e.g., such as provided by the wireless communication system) with other computing devices, such as remote computers, an item providing system, and so forth. The modem 622 may be connected to RF circuit 683 and zero or more RF modules 686. The RF circuit 683 may be a WLAN module, a WAN module, PAN module, or the like. The antenna 688 is coupled to the RF circuit 683, which is coupled to the modem 622. Zero or more antennas 684 may be coupled to one or more RF modules 686, which are also connected to the modem 622. The zero or more antennas 684 may be GPS antennas, NFC antennas, other WAN antennas, WLAN or PAN antennas, or the like. The modem 622 allows the user device 605 to handle both voice and non-voice communications (such as communications for text messages, multimedia messages, media downloads, web browsing, etc.) with a wireless communication system. The modem 622 may provide network connectivity using any type of mobile network technology including, for example, cellular digital packet data (CDPD), general packet radio service (GPRS), EDGE, universal mobile telecommunications system (UMTS), 1 times radio transmission technology (1×RTT), evaluation data optimized (EVDO), high-speed down-link packet access (HSDPA), Wi-Fi®, Long Term Evolution (LTE) and LTE Advanced (sometimes generally referred to as 4G), etc.

The modem 622 may generate signals and send these signals to antenna 688 and antenna 684 via RF circuit 683 and RF module(s) 686 as described herein. User device 605 may additionally include a WLAN module, a GPS receiver, a PAN transceiver and/or other RF modules. These RF modules may additionally or alternatively be connected to one or more of antennas 684, 688. Antennas 684, 688 may be configured to transmit in different frequency bands and/or using different wireless communication protocols. The antennas 684, 688 may be directional, omnidirectional, or non-directional antennas. In addition to sending data, antennas 684, 688 may also receive data, which is sent to appropriate RF modules connected to the antennas.

In one embodiment, the user device 605 establishes a first connection using a first wireless communication protocol, and a second connection using a different wireless communication protocol. The first wireless connection and second wireless connection may be active concurrently, for example, if an electronic device is downloading a media item from a server (e.g., via the first connection) and transferring a file to another electronic device (e.g., via the second connection) at the same time. Alternatively, the two connections may be active concurrently during a handoff between wireless connections to maintain an active session (e.g., for a telephone conversation). Such a handoff may be performed, for example, between a connection to a WLAN hotspot and a connection to a wireless carrier system. In one embodiment, the first wireless connection is associated with a first resonant mode of an antenna structure that operates at a first frequency band and the second wireless connection is associated with a second resonant mode of the antenna structure that operates at a second frequency band. In another embodiment, the first wireless connection is associated with a first antenna element and the second wireless connection is associated with a second antenna element. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a modem 622 is shown to control transmission and reception of an antenna (684, 688), the user device 605 may alternatively include multiple modems, each of which is configured to transmit/receive data via a different antenna and/or wireless transmission protocol.

The user device 605 delivers and/or receives items, upgrades, and/or other information via the network. For example, the user device 605 may download or receive items from an item providing system. The item providing system receives various requests, instructions and other data from the user device 605 via the network. The item providing system may include one or more machines (e.g., one or more server computer systems, routers, gateways, etc.) that have processing and storage capabilities to provide the above functionality. Communication between the item providing system and the user device 605 may be enabled via any communication infrastructure. One example of such an infrastructure includes a combination of a wide area network (WAN) and wireless infrastructure, which allows a user to use the user device 605 to purchase items and consume items without being tethered to the item providing system via hardwired links. The wireless infrastructure may be provided by one or multiple wireless communications systems, such as one or more wireless communications systems. One of the wireless communication systems may be a wireless local area network (WLAN) hotspot connected with the network. The WLAN hotspots may be created by products using the Wi-Fi® technology based on IEEE 802.11x standards by Wi-Fi Alliance. Another of the wireless communication systems may be a wireless carrier system that may be implemented using various data processing equipment, communication towers, etc. Alternatively, or in addition, the wireless carrier system may rely on satellite technology to exchange information with the user device 605.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The electronic devices 605 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The electronic devices 605 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "ally inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. An electronic device comprising:

a radio frequency (RF) feed;

an RF circuit coupled to the RF feed;

an antenna structure coupled to the RF feed with a connector, wherein the antenna structure comprises:

a stacked patch antenna comprising:

a rectangular lower patch structure comprising a first substrate with a ground plane on a bottom side of the first substrate and a first patch element on a top side of the first substrate; and a rectangular upper patch structure that is located above the rectangular lower patch structure, the rectangular upper patch structure comprising a second substrate with a second patch element on a top side of the second substrate;

a first parasitic patch antenna that is coplanar with the rectangular upper patch structure and located adjacent to a first side of the rectangular upper patch structure, the first parasitic patch antenna comprising:

a first body, coplanar to the rectangular upper patch structure, that is adjacent to the first side of the upper patch structure and that is coupled to the rectangular upper patch structure by a first switch;

a first arm, coplanar to the rectangular upper patch structure, that extends out from a first side of the first body in a first direction alongside the first side of the upper patch structure and adjacent to a second side of the rectangular upper patch structure; and a second arm, coplanar to the rectangular upper patch structure, that extends out from the first side of the first body in the first direction alongside the first side of the rectangular upper patch structure and adjacent to a third side of the rectangular upper patch structure; and a second parasitic patch antenna that is coplanar with the rectangular upper patch structure and located adjacent to a fourth side of the rectangular upper patch structure, the second parasitic patch antenna comprising:

a second body, coplanar to the rectangular upper patch structure, that adjacent to the fourth side of the rectangular upper patch structure and that is coupled to the rectangular upper patch structure by a second switch;

a third arm, coplanar to the rectangular upper patch structure, that extends out from a first side of the second body in a second direction alongside the fourth side of the rectangular upper patch structure and adjacent to the second side of the upper patch structure; and a fourth arm, coplanar to the rectangular upper patch structure, that extends out from the first side of the second body in the second direction alongside the fourth side of the rectangular upper patch structure and adjacent to the third side of the rectangular upper patch structure.

2. The electronic device of claim 1, wherein the RF circuit is operable to:

turn on the first switch and turn off the second switch to direct a RF wave away from the first side of the upper patch structure and towards the second side of the upper patch structure; and turn off the first switch and turn on the second switch to direct the RF wave away from the second side of the upper patch structure and towards the first side of the upper patch structure.

3. The electronic device of claim 1, wherein:

the first body is coupled to the upper patch structure by a first set of switches, wherein the first set of switches comprises the first switch;

the second body is coupled to the upper patch structure by a second set of switches, wherein the second set of switches comprises the second switch; and the RF circuit is to configure the first set of switches and the second set of switches to direct a majority of electromagnetic energy of the antenna structure towards a selected direction.

4. An antenna structure comprising:

a stacked patch antenna comprising:

a first patch structure disposed in a first plane, the first patch structure comprising a first substrate with a ground plane on a first side of the first substrate and a first patch element on a second side of the first substrate; and a second patch structure disposed in a second plane, the second patch structure comprising a second substrate with a second patch element on a first side of the second substrate;

a first parasitic patch antenna that is coplanar with the second patch structure, the first parasitic patch antenna comprising:

a first body that is adjacent to a first side of the second patch structure and that is coupled to the second patch structure;

a first arm that extends out from a first side of the first body in a first direction; and a second arm that extends out from the first side of the first body in the first direction; and a second parasitic patch antenna that is coplanar with the second patch structure, the second parasitic patch antenna comprising:

a second body that adjacent to a second side of the second patch structure and that is coupled to the second patch structure;

a third arm that extends out from a first side of the second body in a second direction; and a fourth arm that extends out from the first side of the second body in the second direction.

5. The antenna structure of claim 4, wherein:

the first parasitic patch antenna is coupled to the stacked patch antenna by a first switch; and the second parasitic patch antenna is coupled to the stacked patch antenna by a second switch.

6. The antenna structure of claim 4, wherein:

the first parasitic patch antenna is coupled to the stacked patch antenna by a first set of switches; and the second parasitic patch antenna is coupled to the stacked patch antenna by a second set of switches.

7. The antenna structure of claim 6, wherein the first set of switches are in an on position and the second set of switches are in an off position to direct a RF wave of the antenna structure to a first side of the antenna structure away from the first side of the antenna structure corresponding to the first side of the second patch structure and towards the second side of the antenna structure corresponding to the second side of the second patch structure.

8. The antenna structure of claim 6, wherein a first current of the antenna structure flows from the first parasitic patch antenna to the stacked patch antenna and a second current of the antenna structure flows from a center of the second parasitic patch antenna to an edge of the second parasitic patch antenna.

9. The antenna structure of claim 6, wherein:

the first parasitic patch antenna further comprising:

the first body that is adjacent to the first side of the second patch structure and that is coupled to the second patch structure by a first switch;

the first arm extends in the first direction alongside the first side of the second patch structure and adjacent to a second side of the second patch structure; and the second arm extends in the first direction alongside the first side of the second patch structure and adjacent to a third side of the second patch structure; and the second parasitic patch antenna further comprising:

the second body that adjacent to a fourth side of the second patch structure and that is coupled to the second patch structure by a second switch;

the third arm extends in the second direction alongside the fourth side of the second patch structure and adjacent to the second side of the second patch structure; and the fourth arm extends in the second direction alongside the fourth side of the second patch structure and adjacent to the third side of the second patch structure.

10. An electronic device comprising:

a radio frequency (RF) feed;

an RF circuit coupled to the RF feed;

an antenna structure coupled to the RF feed with a connector, wherein the antenna structure comprises:

a stacked patch antenna comprising:

a lower patch structure comprising a ground plane coupled to a first patch antenna; and an upper patch structure that is stacked above the lower patch, the upper patch comprising a second patch antenna;

a first parasitic patch antenna comprising:

a first body that is parallel to a first side of the stacked patch antenna, the first parasitic patch antenna coupled to the upper patch by a first switch;

a first arm that extends out from a first side of the first body in a first direction; and a second arm that extends out from the first side of the first body in the first direction;

a second parasitic patch antenna comprising:

a second body that is parallel to a second side of the upper patch, the second parasitic patch antenna coupled to the upper patch by a second switch;

a third arm that extends out from a first side of the second body in a second direction; and a fourth arm that extends out from the first side of the second body in the second direction; and an application processor coupled to the RF circuit, the application processor to switch the antenna structure between a first radiation mode and a second radiation mode using the first switch and the second switch.

11. The electronic device of claim 10, wherein:

the first arm is coplanar to the upper patch structure and is parallel to a third side of the upper patch structure;

the second arm is coplanar to the upper patch structure and is parallel to a fourth side of the upper patch structure;

the third arm is coplanar to the upper patch structure and is parallel to the third side of the upper patch structure; and the fourth arm is coplanar to the upper patch structure and is parallel to the fourth side of the upper patch structure.

12. The electronic device of claim 10, wherein:

the antenna structure radiates electromagnetic energy away from the first side of the antenna structure corresponding to the first side of the upper patch structure and towards the second side of the antenna structure corresponding to the second side of the upper patch structure; and the antenna structure radiates electromagnetic energy away from the second side of the antenna structure in the second radiation mode.

13. The electronic device of claim 10, wherein:

the first parasitic patch antenna is coupled to the upper patch by a first set of switches; and the second parasitic patch antenna is coupled to the upper patch by a second set of switches.

14. The electronic device of claim 13, wherein the RF circuit is to:

turn on the first switch from the first of set switches; and turn off the second switch from the second set of switches to orient a RF wave of the antenna structure at an angle.

15. The electronic device of claim 13, wherein:

the first set of switches comprises three switches;

the application processor is to turn one of the three switches on to direct a RF wave, radiated by the antenna structure, at a first angle from a vertical axis of the antenna structure and to a side that is opposite the switches;

the application processor is to turn two of the three switches on to direct the RF wave, radiated by the antenna structure, at a second angle from the vertical axis of the antenna structure and to the side that is opposite the switches, wherein the second angle is an angle that is greater in distance from the vertical axis than the first angle; and the application processor is to turn the three switches on to direct the RF wave, radiated by the antenna structure, at a third angle from the vertical axis of the antenna structure and to the side that is opposite the switches, wherein the third angle is an angle that is greater in distance from the vertical axis than the first angle and the second angle.

16. The electronic device of claim 13, wherein:

when the first set of switches is turned on and the second set of switches is turned off, a first current of the antenna structure flows from the first parasitic patch antenna to the stacked patch antenna and a second current of the antenna structure flows from a center of the second parasitic patch antenna to a first edge of the second parasitic patch antenna; and when the first set of switches is turned off and the second set of switches is turned on, the first current flows from a first edge of the first parasitic patch antenna to a second edge of the first parasitic patch antenna and the second current flows from an edge of the upper patch to a second edge of the second parasitic patch antenna.

17. The electronic device of claim 13, wherein the RF circuit is to configure the first set of switches and the second set of switches to direct a majority of electromagnetic energy of the antenna structure towards a selected direction.

18. The electronic device of claim 13, wherein:

the stacked patch antenna is rectangular;

the first side of the stacked patch antenna is a first side of the stacked patch antenna; and the second side of the stacked patch antenna is a second side of the rectangular stacked patch antenna.

19. The electronic device of claim 13, wherein the RF feed is a coaxial pin connected to the lower patch structure.

20. The electronic device of claim 13, wherein:

the first parasitic patch antenna partially surrounds the first side of the upper patch structure; and the second parasitic patch antenna partially surrounds the second side of the upper patch structure.

* * * * *